US005722097A

United States Patent [19]

Deveer

[11] Patent Number: 5,722,097

[45] Date of Patent: Mar. 3, 1998

[54] MOUNTING MEANS ENABLING TURNING OF VERTICAL SPRAY BIDETS FOR LAVATORIES

[76] Inventor: William B. Deveer, 76-04 Main St. #110, Kew Gardens, N.Y. 11367

[21] Appl. No.: 702,808

[22] Filed: Aug. 26, 1996

[51] Int. Cl.[6] ..... A47K 3/20

[52] U.S. Cl. ..... 4/420.4; 4/443

[58] Field of Search ..... 4/420.4, 447, 443, 4/444

[56] References Cited

U.S. PATENT DOCUMENTS

| | | | |
|---|---|---|---|
| 1,520,892 | 1/1924 | Koppin | 4/420.4 |
| 4,069,519 | 1/1978 | Alexander | 4/447 |
| 4,998,300 | 3/1991 | Sharifzadeh | 4/420.4 |
| 5,359,736 | 11/1994 | Olivier | 4/420.4 |
| 5,504,948 | 4/1996 | Chandler | 4/420.4 |
| 5,566,402 | 10/1996 | Agha el-Rifai et al. | 4/420.4 |

*Primary Examiner*—David J. Walczak

[57] ABSTRACT

A permanent mounting adapter that enables a "U" shaped rigid bidet tubing structure to be placed through a hole on top of the adapter. The adapter is affixed to the lavatory by an ultra high strength double sided adhesive tape. The bidet nozzle is placed directly under the dirty buttocks by moving a handle backward that is part of the tubing structure of the bidet. The bidet nozzle can be moved away after use by moving the handle forward. Moving the handle pivots the rigid bidet structure through the hole on top of the mounting adapter. The mounting adapter and tubing structure are placed below the lavatory seat.

2 Claims, 4 Drawing Sheets

MOUNTING MEANS ENABLING TURNING OF VERTICAL SPRAY BIDETS FOR LAVATORIES

BACKGROUND: Field of Invention

This invention relates to the mounting means for permanently attaching a vertical spray bidet to a lavatory; specifically to a permanent mounting adapter that enables turning of the bidet inside the lavatory bowl. (Vertical spray bidets are bidets that spray water perpendicularly, from directly under the dirty buttocks at 90 degrees, through a "U" shaped tubing inside the lavatory bowl.)

BACKGROUND: Discussion of Prior Art

The mounting means to attach a vertical spray bidet in prior art attached the the vertical spray bidet to the lavatory bowl in a permanent, fixed, position. This fixed position was directly under the buttocks. Prior art mounting means did not allow for moving the bidet structure out of the way when a person is in the process of defecating. (This is the disadvantage in U.S. Pat. No. 3,310,813 to Jonsson, 1967 Mar. 28.) If the bidet structure is not moved away when a person is defecating, then the bidet is soiled. This would lead to un-sanitary conditions when the person is using the bidet after defecating. The water sprayed from the bidet would not be clean. This takes away the sanitary aims of the use of a vertical spray bidet; this situation, in turn, may lead to serious disease. If the Jonsson mounting means is placed on the lavatory after the process of defecating, (and removed after use of the bidet) it would again be un-sanitary; to remove an item, the structure of which had been in the lavatory bowl. This may lead to serious disease when handling the bidet structure in and out the lavatory bowl.

This temporary use of the bidet (if the Jonsson mounting means is used as such), in placing and removing the bidet structure out of the lavatory bowl, negates the hygienic use and concept of a sanitary device such as a bidet.

OBJECTS AND ADVANTAGES

My invention enables a vertical spray bidet to be attached to a lavatory, while enabling the bidet structure to be moved out of the way when a person is in the process of defecating.

This would enable the bidet to be permanently attached to the lavatory, and at the same time, it can be moved away from the center of the lavatory when a person is defecating. The bidet can also be moved to the center of the lavatory (to use the bidet) after a person has completed defecating.

My invention would also permanently attach the vertical spray bidet to the lavatory, without the need to have the bidet (the structure of which had been inside the lavatory) to be placed and removed each time the bidet needs to be used. This would lead to a sanitary use of the bidet, reducing the risk of serious disease.

Further Objects and Advantages of my invention will become apparent from a consideration of the drawings and ensuing description.

DESCRIPTION OF THE DRAWING FIGURES

LIST OF REFERENCE NUMERALS

| REF. NO. | PARTS OF THE DRAWINGS |
|---|---|
| 20 | flexible plastic tubing that is attached to a water source |
| 21 | the handle of the vertical spray bidet |
| 22 | the structure of the permanent mounting adapter |
| 23 | an ultra high strength double sided adhesive tape |
| 24 | the spray nozzle of the vertical spray bidet |
| 25 | cross sectional view of the lavatory |
| 26 | the hole on the permanent mounting adapter for inserting the bidet structure |
| 27 | the lavatory seat |
| 28 | the tubing structure of the vertical spray bidet |
| 29 | the lavatory - from an overhead view |

SUMMARY

The Permanent Mounting Adapter enables the permanent attachment of a vertical spray bidet to a lavatory. This Permanent Mounting Adapter also enables the "U" shaped bidet structure to move inside the lavatory bowl (this enables the vertical spray bidet structure to be moved away from the center of the lavatory bowl, when a person is in the process of defecating, and moved back to the center after defecating.) This is a better method of mounting means than fixed mounting means, whereby the "U" shaped bidet structure is directly under a person during the process of defecating. These fixed mounting adapters cannot be moved away when a person is in the process of defecating. This would lead to soiling of the bidet nozzle, and could lead to serious disease during the use of a bidet after defecating.

The Permanent Mounting Adapter for vertical spray bidets is also more hygienic than other mounting means that are temporary (where the entire bidet structure is placed inside the lavatory bowl and removed out of the lavatory bowl after use.) The handling of such a structure which had been inside the lavatory bowl could lead to serious disease.

DESCRIPTION OF THE INVENTION

Figure 1:
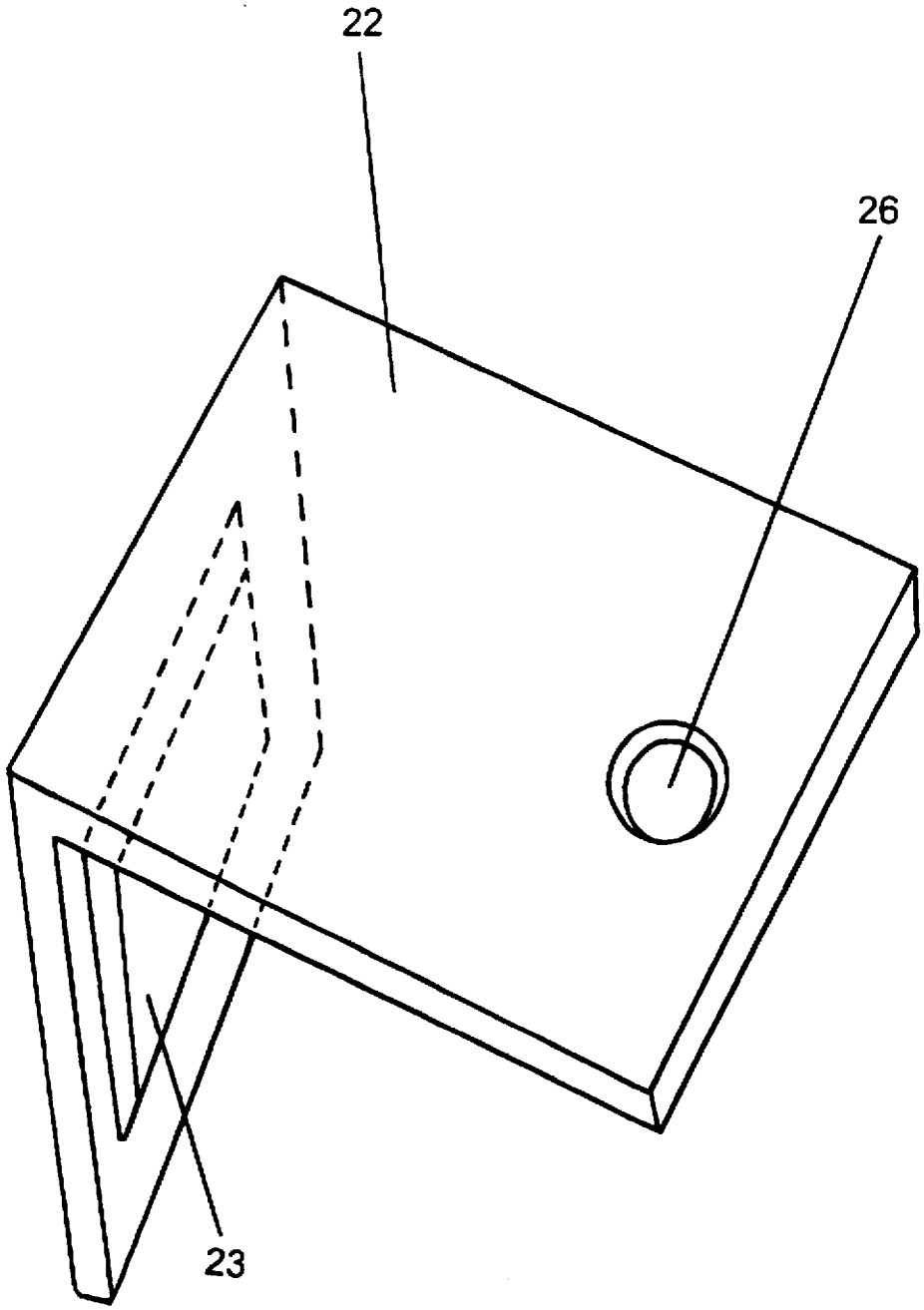
FIG. 1 shows the structure of the permanent mounting adapter.
Figure 3:
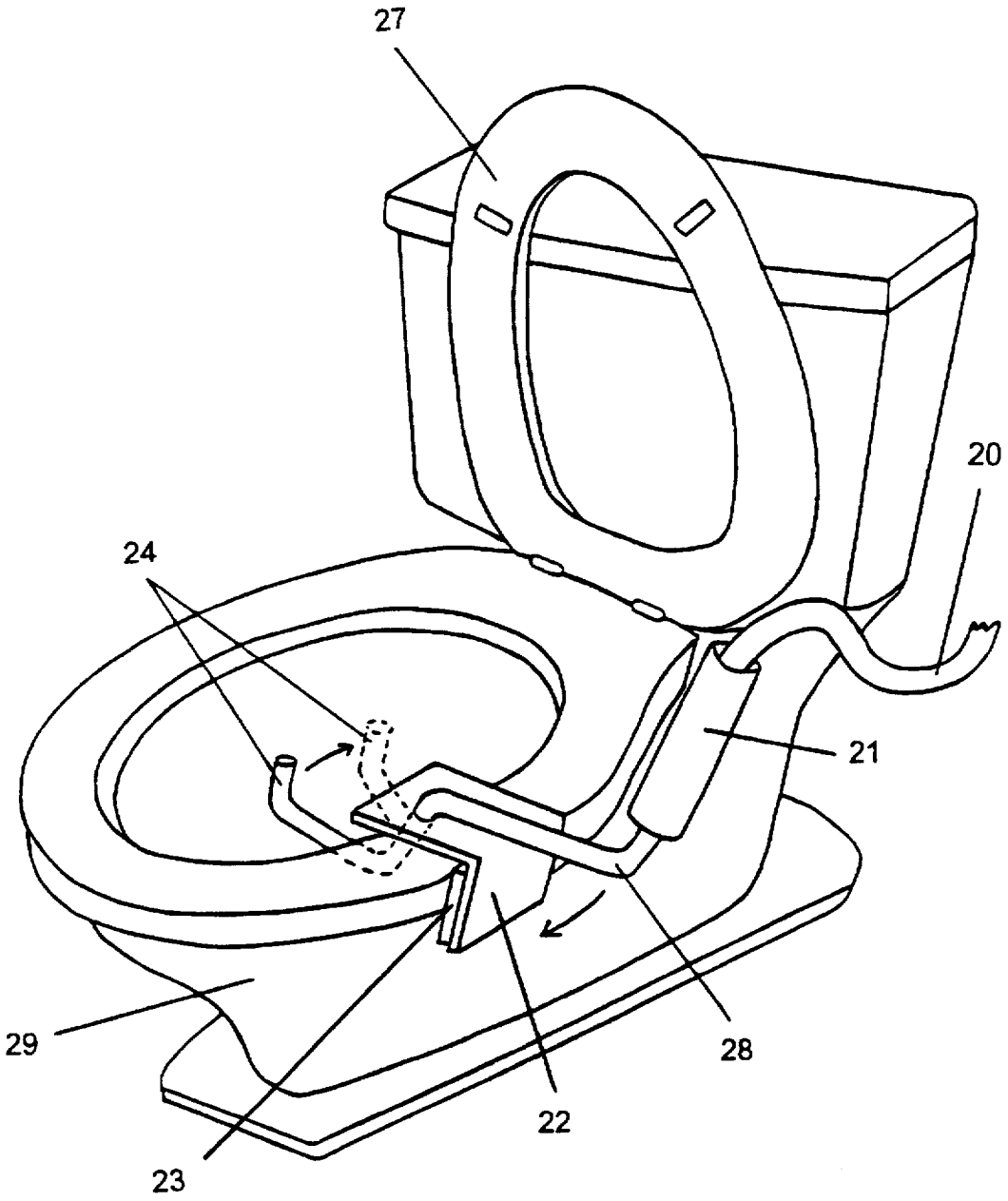
FIG. 3 shows an overhead view of the vertical spray bidet structure, the permanent mounting adapter, and a second position of the bidet structure if the handle of the bidet structure is moved forward. The overhead view is looking from the top of the lavatory.
Figure 4:
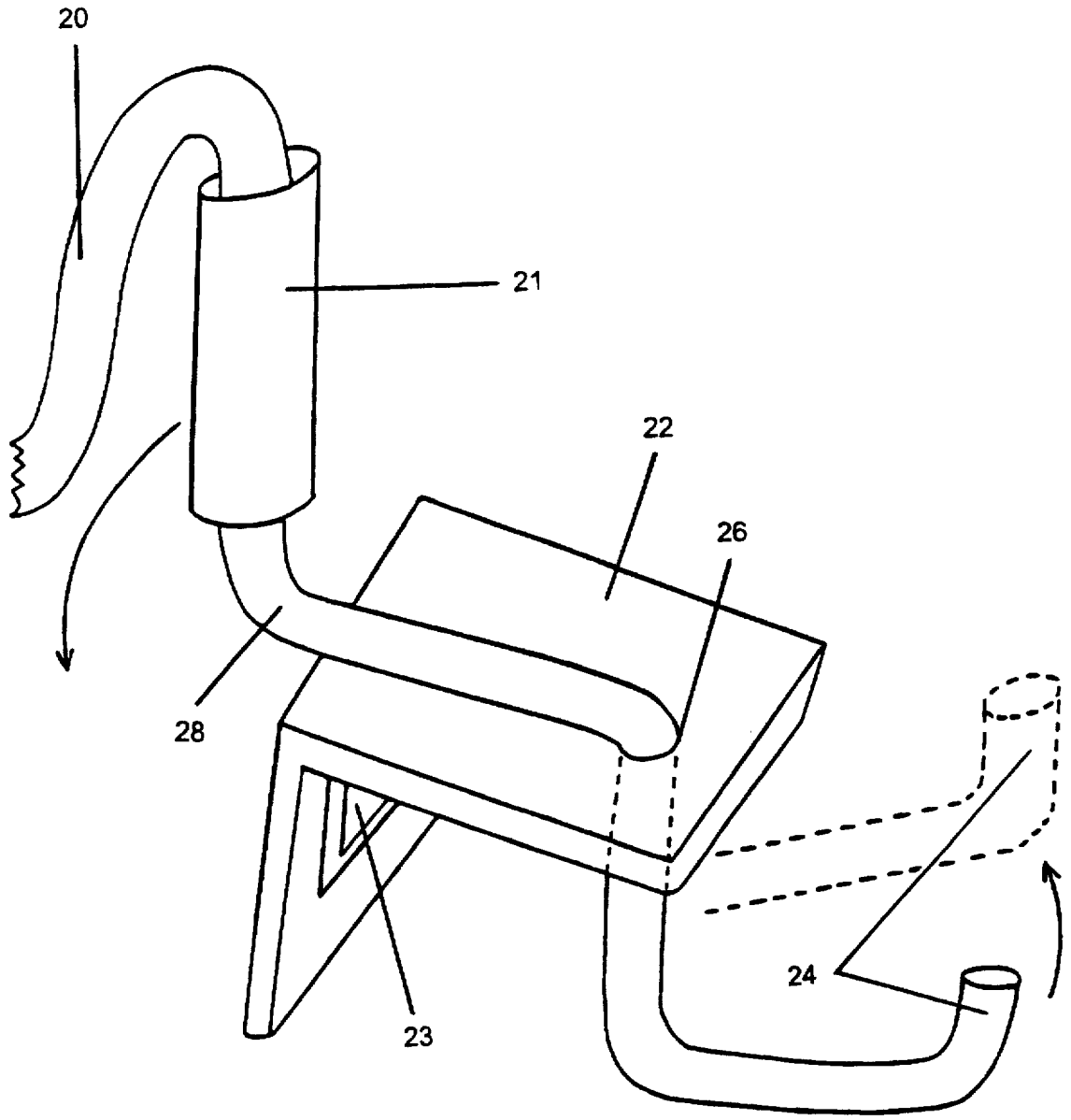
FIG. 4 shows a larger view of the vertical spray bidet structure placed on top of the permanent mounting adapter. The turning of the handle in the direction indicated by by the arrow next to the handle, pivots the vertical spray bidet nozzle towards the back of the lavatory and vice versa.

The main structure of the Permanent Mounting Adapter 22, is made of lightweight aluminum and shaped as shown in FIG. 1. Mounting Adapter 22, includes a hole 26, through which a rigid tubing structure 28 of the vertical spray bidet is placed. Mounting Adapter 22, is affixed to the outer side of the lavatory bowl by use of an ultra high strength double sided adhesive tape 23, which is placed on the inside leg of Mounting Adapter 22, opposite to the leg with hole 26. Ultra high strength double sided tape 23, (with 140 lb. per square inch adhesive strength) is manufactured/sold by Tandy Corp., of Ft. Worth, Tex. 76102. Vertical spray bidet rigid tubing structure 28 is placed atop Mounting Adapter 22, as seen in FIG. 4, and (as stated earlier) tubing 28 is put through hole 26. This assembly is then placed and affixed to a lavatory bowl 29, below a lavatory seat 27 (as shown in FIG. 3.)

Figure 2:
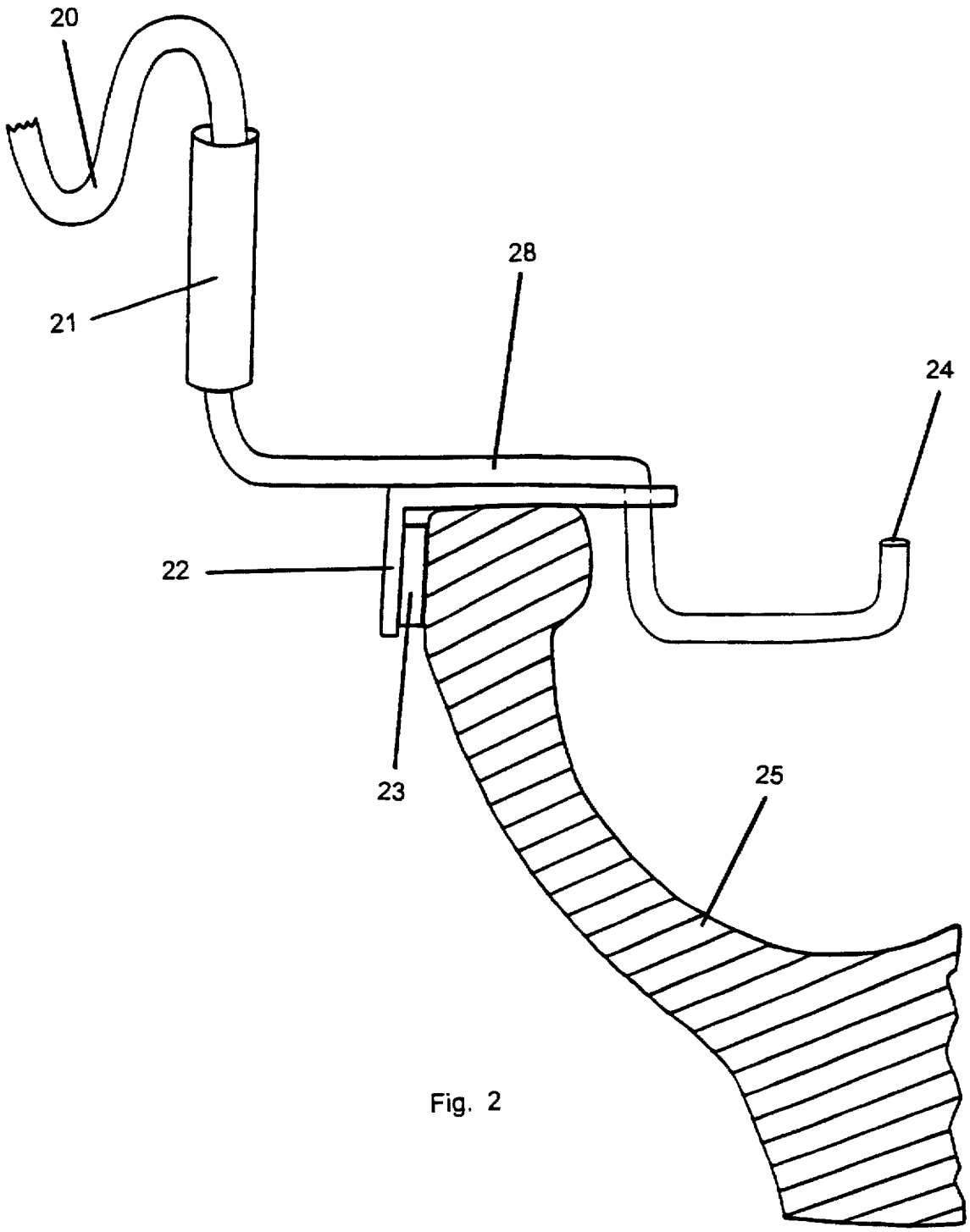
FIG. 2 shows a cross-sectional view of the lavatory and the permanent mounting means affixed to the left of the cross- section. The vertical spray bidet structure can also be seen placed on top of the permanent mounting adapter.

Mounting Adapter 22 is long enough to clear the width of the rim of the lavatory bowl, with ultra high strength double sided tape 23 being affixed to the outer edge of the lavatory bowl (this can be seen in FIG. 2.) Tubing 28 of the vertical spray bidet structure has also cleared the inner edge of the rim of the lavatory bowl as as shown in FIG. 2.

Flexible plastic tubing 20, is connected to the rigid hollow bidet tubing structure 28, and to a water source at the other end.

OPERATION OF INVENTION

The Permanent Mounting Adapter for permanently attaching a vertical spray bidet to a lavatory bowl is used by moving the handle of the attached vertical spray bidet as indicated by the arrow next to handle 21 in FIG. 4. The movement of the handle, forward or backward, turns the rigid tube 28 through hole 26, which pivots nozzle 24 directly under the dirty buttocks to be cleansed. The moving of spray nozzle 24 in lavatory bowl 29, can be seen in FIG. 3. Rigid tubing structure 28 of the vertical spray bidet turns through hole 26 when handle 21 is moved forward or backward (FIG. 3 & 4.) Before defecating, a person would move handle 21 forward; this would pivot the nozzle towards the back of the lavatory bowl. After defecating, a person would move the handle backward from the previous position (before defecation.) This would pivot the spray nozzle directly under the dirty buttocks for cleansing.

CONCLUSION, RAMIFICATIONS, AND SCOPE OF INVENTION

The Permanent Mounting Adapter for permanently attaching a vertical spray bidet to the lavatory bowl enables the moving of the spray nozzle towards the back of the lavatory bowl. This is done by moving the handle of the bidet forward before defecating. When the handle of the bidet is moved backward, the Permanent Mounting Adapter allows for the turning of the spray nozzle to the center of the lavatory bowl for cleansing of the dirty buttocks. This would lead to increased hygiene over a mounting means that would fix the "U" shaped vertical spray bidet structure in an immovable position directly under the defecating person or, a mounting means that requires the placing and removal of the "U" shaped bidet structure from inside of the lavatory bowl each time a person has to defecate. Therefore, the scope of my invention would lead to a better sanitary and hygienic use of a vertical spray bidet, and reduce the risk of serious disease. The main structure of the Permanent Mounting Adapter includes a hole through which the rigid tubing structure of the "U" shaped bidet structure would turn when the handle of the bidet is moved forward or backward. The main structure of the Permanent Mounting Adapter is affixed to the outer edge of the lavatory bowl by use of an ultra high strength double sided adhesive tape.

While my above description contains many specificities, these should not be construed as limitations on the scope of the invention, but rather as an exemplification of one preferred embodiment thereof.

I claim:

1. A bidet assembly adapted to be mounted onto a rim of a toilet bowl having a seat, said bidet assembly comprising:

a mounting adapter having a first side adapted to extend along an outer surface of the rim, a second side adapted to be spaced from and extend along an inner surface of the rim and a third side connecting the first and second sides and adapted to extend along an upper surface of the rim, said third side having an aperture therethrough;

a rigid hollow tube having a U-shaped portion adapted to be positioned within the toilet bowl, said U-shaped portion comprising a first vertical leg for spraying water onto a user, a second vertical leg having an upper end which extends through said aperture and a third leg which connects the first and second legs, said rigid hollow tube further including a horizontal portion which extends from said upper end of said second vertical leg and which extends along an upper surface of said third side of said mounting adapter;

a flexible tube connected to said horizontal portion of said rigid hollow tube for supplying water to said rigid hollow tube; and a handle connected to said horizontal portion of said rigid hollow tube whereby said handle is adapted to be pulled rearwardly by a user sitting on the seat of the toilet bowl in order to pivot said U-shaped portion of said rigid hollow tube about said aperture to thereby move said first vertical leg of said hollow rigid tube from a position near a rear portion of the toilet bowl to a position beneath the user.

2. The bidet assembly as defined in claim 1 wherein double sided tape is mounted on said first side of said mounting adapter and adapted to contact the outer surface of the rim for securing said mounting adapter to the rim.

* * * * *